US008182612B2

(12) United States Patent
Grunert

(10) Patent No.: US 8,182,612 B2
(45) Date of Patent: May 22, 2012

(54) METHOD FOR REMOVING LINT FROM A HEAT EXCHANGER OF A DOMESTIC APPLIANCE AND CORRESPONDING DOMESTIC APPLIANCE

(75) Inventor: Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 131 days.

(21) Appl. No.: 12/516,658

(22) PCT Filed: Nov. 23, 2007

(86) PCT No.: PCT/EP2007/062771

§ 371 (c)(1),
(2), (4) Date: May 28, 2009

(87) PCT Pub. No.: WO2008/077708

PCT Pub. Date: Jul. 3, 2008

(65) Prior Publication Data

US 2010/0065087 A1 Mar. 18, 2010

(30) Foreign Application Priority Data

Dec. 22, 2006 (DE) ..... 10 2006 061 211

(51) Int. Cl.
*B08B 3/04* (2006.01)

(52) U.S. Cl. ..... 134/34; 134/22.18; 134/24; 134/37

(58) Field of Classification Search ..... 134/22.18, 134/24, 34, 37

See application file for complete search history.

(56) References Cited

U.S. PATENT DOCUMENTS

| | | | | |
|---|---|---|---|---|
| 5,226,203 | A | 7/1993 | Sacconato et al. | |
| 5,879,466 | A * | 3/1999 | Creger et al. | 134/18 |
| 2005/0066538 | A1 * | 3/2005 | Goldberg et al. | 34/218 |

FOREIGN PATENT DOCUMENTS

| | | | |
|---|---|---|---|
| DE | 3738031 | A1 | 5/1989 |
| DE | 4333901 | C1 * | 2/1995 |
| DE | 19547613 | A1 | 6/1996 |
| DE | 19600489 | A1 * | 7/1996 |
| DE | 19943125 | A1 | 11/2000 |
| DE | 10002743 | A1 | 8/2001 |

OTHER PUBLICATIONS

Machine translation of DE 196 00 489A1 to Jording et al.*
Machine translation of DE 43 33 901C1 to Fuchs.*
Machine translation of DE 196 00 489A1 to Jording et al. (provided by Google Translate).*

* cited by examiner

*Primary Examiner* — Michael Kornakov
*Assistant Examiner* — Douglas Lee
(74) *Attorney, Agent, or Firm* — James E. Howard; Andre Pallapies

(57) ABSTRACT

A method is provided for the removal from a heat exchange of lint that is generated during a drying process in a domestic appliance for laundry care. A rinsing fluid is run through the heat exchanger for cleaning and the rinsing fluid is deflected during a cleaning phase with the magnitude of deflection or the direction of deflection of the rinsing fluid being a function of the strength of an air flow that is applied to deflect the rinsing fluid. The rinsing fluid is thus run through various regions of the heat exchanger depending on the deflection.

12 Claims, 1 Drawing Sheet

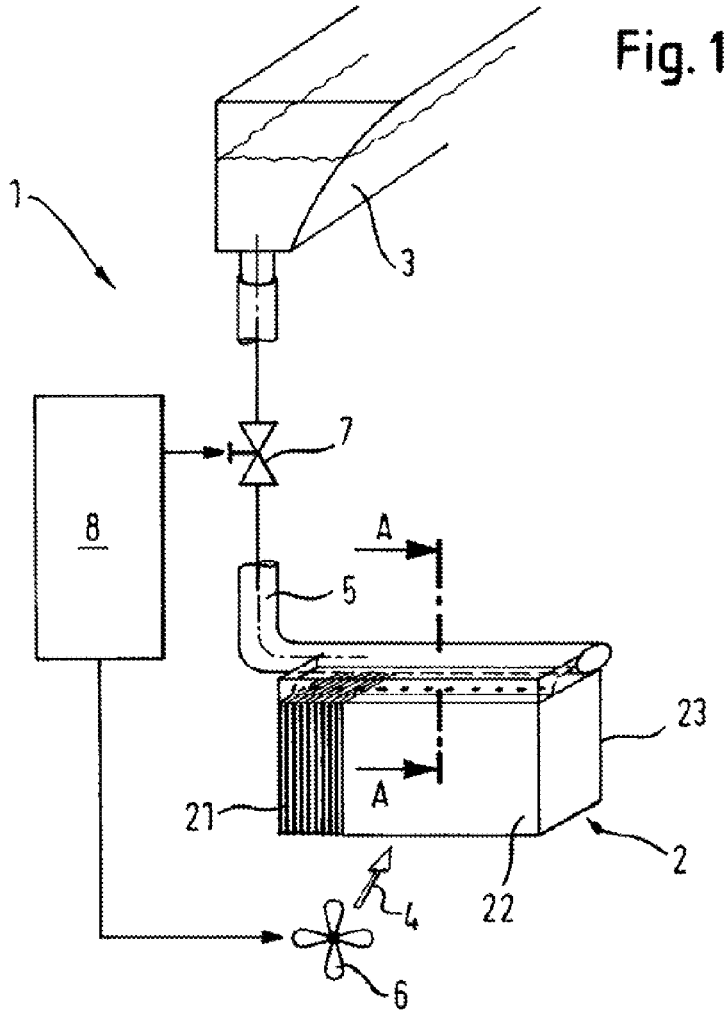
Fig. 1
Fig. 2
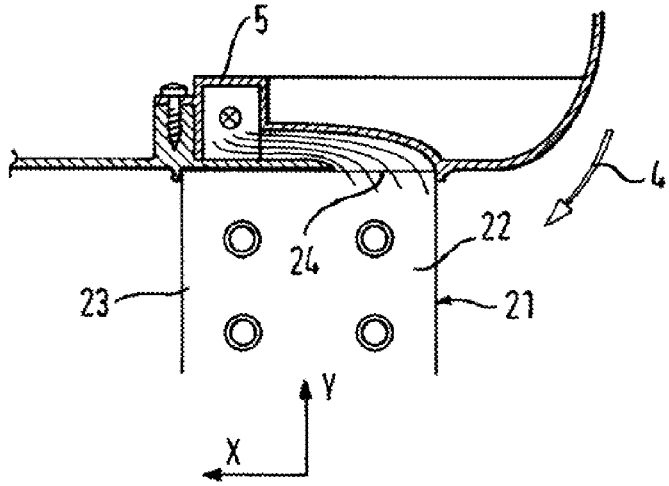

METHOD FOR REMOVING LINT FROM A HEAT EXCHANGER OF A DOMESTIC APPLIANCE AND CORRESPONDING DOMESTIC APPLIANCE

BACKGROUND OF THE INVENTION

The invention relates to a method for the removal of lint, generated during the drying process in a domestic appliance, especially a tumble dryer, for laundry care, from a heat exchanger, wherein a rinsing fluid is run through the heat exchanger for cleaning.

The invention also relates to a domestic appliance for laundry care, comprising a heat exchanger, a process air blower for driving an air flow through the heat exchanger, a collection vessel for a rinsing liquid for removal of the lint generated during the drying process from the heat exchanger, whereby in a cleaning phase the rinsing liquid is conveyed through the heat exchanger, as well as a control device for controlling the cleaning.

A method as well as a domestic appliance of this type are known from DE 37 38 031 C2.

In addition tumble dryers are known which feature a compressor heat pump for alternate heating up and cooling down of a circulating flow of process air. In addition to the normal lint filter, these devices have additional filter systems in order to avoid lint collecting on the respective coolant heat exchanger. To create a good heat transfer from the working medium or coolant circulating in the heat pump to the process air flow which brings about the actual drying process, such heat exchangers are structured with relatively fine elements with a great plurality of fins and are therefore more susceptible than heat exchangers in normal tumble dryers without heat pumps to contamination by lint. The corresponding filter systems consist of a number of mesh filters, filter screens or similar connected one after the other for removal of the fine lint from the process air passing through the normal lint filter. These are intended to keep the heat exchangers permanently installed in the domestic appliance free from fine lint, in order to achieve a good heat transfer from the coolant to the process air flow in this way. Since the filter systems are installed in the area of the base of the device however, maintaining them involves a very tedious process. In addition the cleaning cycles are relatively short and cleaning is very complicated per se.

BRIEF SUMMARY OF THE INVENTION

The object of the present invention is thus to create a process in which the removal of lint in a heat exchanger of a domestic appliance for laundry care can be undertaken in an improved manner. In particular when rinsing liquid is passed through the heat exchanger is the removal of the lint accumulated therein to be effectively undertaken. A correspondingly equipped domestic appliance is also to be specified.

This object is achieved by a method having the features of claim 1 and a domestic appliance having the features of claim 8. Preferred developments of the invention are specified in the dependent claims. Preferred developments of the method correspond to preferred developments of the domestic appliance even if this is not explicitly specified in each case.

With the inventive method for removal from a heat exchanger of lint generated during a drying process of a domestic appliance for laundry care, a rinsing liquid is conveyed through the heat exchanger. The rinsing liquid is diverted during a cleaning phase depending on the strength of an air flow able to be generated and, depending on this diversion, the rinsing liquid flows through the various areas of the heat exchanger. This enables the removal of lint from the heat exchanger to be achieved highly effectively. By the rinsing liquid being directed individually to different points of the heat exchanger, practically all areas of the heat exchanger can be freed from lint. This enables not just a relatively simple and straightforward process but also improved cleaning to be guaranteed. Deposits on the fins of the heat exchanger both in its front and in its rear area are thus removed by this efficient cleaning. The performance data of the device, especially the energy consumption and the time required are optimized by this method. In addition it is no longer necessary to undertake any other mandatory cleaning of filter systems.

With the inventive domestic appliance for laundry care, comprising a heat exchanger, a process air blower for driving an air flow through the heat exchanger, a collection vessel for a rinsing liquid for removal from the heat exchanger of lint generated during a drying process, whereby in a cleaning phase the rinsing liquid is directed through the heat exchanger, as well as a control device for controlling the cleaning the control device, the control device is configured such that during the cleaning phase the process air blower is able to be operated for blowing the flow of air, with the rinsing liquid being diverted depending on the strength of the air flow and, depending on the diversion, flowing through various areas of the heat exchanger.

Preferably the air flow is generated by a process air blower of the domestic appliance and directed through the heat exchanger. The process air blower unit present in any event in the domestic appliance is thus used in a multifunctional capacity. An air flow is thus generated or not generated depending on the operating state of the process air blower.

Preferably the rinsing liquid is directed through a front area of the heat exchanger when the generation of the air flow is deactivated. The front area is to be understood as that part of the heat exchanger which, when the air flow is activated, is intended as in the direction of flow as the air flow area and therefore will be reached first by the circulating process air flow. If the process air blower is thus turned off, the front area of the heat exchanger is cleaned while the rinsing liquid flows through this front area.

The rinsing liquid preferably flows through a rear area of the heat exchanger in the direction of flow of the flow or air when the generation of the air flow is activated. Preferably, when the process air blower is switched on, the inflowing rinsing liquid is thus diverted so that it flows through the rear area of the heat exchanger and thus rinses off the lint collected there.

When the process air blower is running the liquid is thus pushed by the static and dynamic pressure of the process air further between the fins of the heat exchanger by which a cleaning of the rear fin areas can be achieved.

Preferably a condensate generated during a drying process in the domestic appliance is collected as rinsing liquid for cleaning the heat exchanger. Thus a material-saving liquid is used here to which occurs during the drying process. A separate additional liquid for cleaning is thus not necessary. This embodiment usefully uses a product actually occurring as waste, the condensate, for cleaning the heat exchanger.

Preferably the heat exchanger is assigned to a heat pump of the domestic appliance. The heat pump can be embodied as a compressor heat pump. Arranged therein in a known manner between two heat exchangers are a compressor for the working liquid or coolant (chlorinated and/or fluorinated hydrocarbon or carbon dioxide) and a throttle. In a first heat exchanger which is the one through which the process air stream laden with moisture first passes and is thus especially in danger of contamination by lint, the coolant is evaporated at low pressure, whereby it takes up heat and thereby cools the process air flow, the evaporated coolant is compressed in a compressor to a relatively high pressure and conveyed to the second heat exchanger where it heats up the process air flow by emitting heat and is thereby condensed. In a throttle following the second heat exchanger the condensed coolant is decompressed to the low pressure mentioned and thus arrives back at the first heat exchanger.

Preferably the cleaning of the heat exchangers and thereby the removal of lint from the heat exchangers is undertaken towards the end of the drying process of the laundry loaded into the domestic appliance and especially at a time at which the lint is still damp.

The rinsing liquid is preferably introduced from above into the heat exchanger and then circulates through the fins of the heat exchanger. The high flow speed and the opportunity of introducing a relatively large quantity of liquid achieved in this way allows the lint adhering to be rinsed off effectively.

Preferably the domestic appliance comprises a line with a valve able to be controlled by the control device, with said line connecting the collection vessel to the heat exchanger.

BRIEF DESCRIPTION OF THE DRAWINGS

An exemplary embodiment of the invention is explained in greater detail below with a reference to schematic drawings. The figures show:

FIG. 1 a perspective drawing of components of a domestic appliance of importance for the subsequent explanation; and FIG. 2 a cross-sectional diagram along the cut line AA depicted in FIG. 1.

DETAILED DESCRIPTION OF THE PRESENT INVENTION

In the figures elements which are the same or have the same functions are provided with the same reference numbers.

A tumble dryer 1 comprises a compressor heat pump 2 (cf. above description; only shown in part here for reasons of clarity) which comprises a heat exchanger 2. The heat exchanger 2 comprises a plurality of fins 21 and is coupled to a process air guide. The result able to be achieved by this is that during operation of the tumble dryer 1, especially during the drying phase, process air is directed as a flow of air 4 in the direction shown by the arrow through the heat exchanger 2. The air flow 4 generated in the process air guide is generated by a process air blower 6 depicted only schematically in the diagram, which can be activated and deactivated as required.

In addition the tumble dryer 1 includes a collection vessel 3 which is arranged in a vertical direction on a higher level than the heat exchanger 2. In the collection vessel 3 there is condensate which is generated during the drying process and pumped into the collection vessel 3.

Arranged between the collection vessel 3 and the heat exchanger 2 is a line 5, through which the liquid contained in the collection vessel 3 can be conveyed to the heat exchanger 2. A valve enables the line 5 to be opened or closed again.

A control device 8 is configured, especially programmed, so that it can control the method for removal of lint generated during a drying process (which it preferably also controls) from the heat exchanger 2. To do this, as indicated by appropriate arrows, it controls the process air blower 6 and the valve 7. The corresponding method steps are explained below.

To remove the lint which has collected in the heat exchanger 2 and especially on the fins 21 during a drying process, during a drying process the condensate collected in the collection vessel 3 is conveyed through the heat exchanger 2. In this process the condensate serves as rinsing liquid to enable the lint to be rinsed out of the heat exchanger 2.

FIG. 2 shows a schematic cross-sectional diagram along the cut line AA depicted in FIG. 1. As can be seen from this diagram, the air flow that 4 generated by the process air blower flows onto a forward area 22 of the heat exchanger 2 in the direction of flow and exits at a rear end or rear area 23 again in the direction of flow. The arrangement of the line 5 on the heat exchanger 2 is embodied so that the rinsing liquid is introduced from above into the front area 22 of the heat exchanger 2. If the process air blower is switched off and thus also does not generate any air flow 4, the rinsing liquid flows from above downwards through the heat exchanger 2 essentially into this front area 22, which typically extends to about the center (viewed in the x-direction).

If the process air blower is activated or remains activated and the air flow 4 flows through the heat exchanger 2 in the direction of flow indicated, the flow of rinsing liquid introduced at the front area 22 is diverted in the x-direction, by which the rear area 23 of the heat exchanger 2 is also flowed through by this rinsing liquid and the lint adhering to this area is rinsed away.

Depending on whether an air flow 4 is to be generated or not or on the strength with which the air flow is generated, the course of the flow of rinsing liquid can also be influenced. In particular the rinsing liquid can be diverted by the air flow 4 into different areas of the heat exchanger 2 which also allows the rinsing liquid to flow through different areas.

To provide large amounts of liquid for the cleaning the condensate is collected in the collection vessel 3. Towards the end of the drying process and at a time at which the lint adhering to the surfaces of the heat exchanger is still damp, an emptying opening of the collection vessel 3 is released and the condensate used as rinsing liquid is conveyed to the heat exchanger 2 via a line 5 embodied where possible with a large cross section and rinsed from above over the fins 21 of the heat exchanger 2. An especially large opening 24 is embodied in this purpose so that a blockage of the opening, by lint or example, can be prevented.

Lint adhering to the fins 21 is rinsed away by the higher flow speed and the large amount of liquid. The lint can subsequently be pumped away with the condensate into the waste water system. There can also be provision for a rinsing-through of the heat exchanger 2 to be undertaken at least twice and for the rinsing liquid, after a first pass, to be pumped back into the collection vessel 3 and then to flow through the heat exchanger 2 once more.

The invention claimed is:

1. A method for removal of lint, the method comprising:

during a drying process of a domestic appliance for care of laundry, conveying rinsing liquid through a heat exchanger on which lint has collected to effect dislodgement of lint from one area of the heat exchanger; and redirecting the rinsing fluid to effect dislodgement of lint from another area of the heat exchanger, the redirecting of the rinsing fluid being effected via varying at least one of a magnitude of an air flow that impacts the rinsing fluid and a direction of the air flow, whereupon rinsing fluid is directed to flow through various areas of the heat exchanger.

2. The method as claimed in claim 1, wherein the air flow is generated by a process air blower of the domestic appliance and flows through the heat exchanger.

3. The method as claimed in claim 1, wherein the rinsing liquid flows in a direction of flow of the air flow through a front area of the heat exchanger when the generation of the air flow is deactivated.

4. The method as claimed in claim 1, wherein the rinsing liquid flows in a direction of flow of the air flow through a rear area of the heat exchanger when the generation of the air flow is activated.

5. The method as claimed in claim 1, wherein, for cleaning the heat exchanger, a condensate generated during a drying process in the domestic appliance is collected as the rinsing liquid.

6. The method as claimed in claim 1, wherein the cleaning is undertaken towards the end of a drying process in the domestic appliance and at a time at which the lint is still damp.

7. The method as claimed in claim 1, wherein the rinsing liquid is introduced from above into the heat exchanger and rinses a plurality of fins of the heat exchanger.

8. The method as claimed in claim 1, wherein the air flow, when generated, is oriented in an air flow direction that is substantially across or transverse to a rinsing liquid direction along which the rinsing liquid is initially conveyed along the heat exchanger.

9. A domestic appliance for care of laundry, the domestic appliance comprising:

a heat exchanger;

a process air blower for driving an air flow through the heat exchanger;

a collection vessel for collecting a supply of rinsing liquid, the rinsing liquid being conveyable through the heat exchanger for removal from the heat exchanger of lint generated during a drying process; and a control device for controlling the cleaning from the heat exchanger of lint, the control device programmed to control at least one of a magnitude of an air flow that impacts the rinsing fluid and a direction of the air flow such that, during a cleaning phase, rinsing liquid is redirected by the influence of the air flow thereagainst to flow through various areas of the heat exchanger.

10. A domestic appliance as claimed in claim 9 and further comprising a line with a valve controlled by the control device, the line connecting the collection vessel with the heat exchanger.

11. A domestic appliance as claimed in claim 9, wherein the heat exchanger is operatively associated with a heat pump of the domestic appliance.

12. The domestic appliance as claimed in claim 9, wherein the process air blower is oriented to generate an airflow in an air flow direction that is substantially across or transverse to a rinsing liquid direction along which the rinsing liquid is initially conveyed along the heat exchanger.

* * * * *